US008827693B2

(12) United States Patent
Akagi

(10) Patent No.: US 8,827,693 B2
(45) Date of Patent: Sep. 9, 2014

(54) TOTALLY AERATED COMBUSTION BURNER

(75) Inventor: Kazuyuki Akagi, Nagoya (JP)

(73) Assignee: Rinnai Corporation, Aichi (JP)

( * ) Notice: Subject to any disclaimer, the term of this patent is extended or adjusted under 35 U.S.C. 154(b) by 473 days.

(21) Appl. No.: 13/274,488

(22) Filed: Oct. 17, 2011

(65) Prior Publication Data

US 2013/0095441 A1 Apr. 18, 2013

(51) Int. Cl.
*F23D 3/40* (2006.01)
*F23D 14/62* (2006.01)

(52) U.S. Cl.
CPC ..... *F23D 14/62* (2013.01)
USPC ..... 431/326; 431/327; 431/328; 431/329; 431/354

(58) Field of Classification Search
CPC ..... F24D 14/12; F24D 14/14; F24D 14/145; F24D 14/18; F24D 14/34; F23D 2203/005
USPC ..... 431/326–329, 182, 354
See application file for complete search history.

(56) References Cited

U.S. PATENT DOCUMENTS 2,526,122 A * 10/1950 Darlington ..... 60/743
3,348,472 A * 10/1967 Anetsberger et al. ..... 99/447
3,787,169 A * 1/1974 Gjerde ..... 431/347
3,932,119 A * 1/1976 Alms et al. ..... 432/101
4,493,638 A * 1/1985 Scammell ..... 431/202
4,639,213 A * 1/1987 Simpson ..... 431/326
4,643,670 A * 2/1987 Edwards et al. ..... 431/202
4,737,102 A * 4/1988 Jinno et al. ..... 431/328
4,913,041 A * 4/1990 Taber et al. ..... 99/403
5,062,788 A * 11/1991 Best ..... 431/7
5,263,852 A * 11/1993 Beck ..... 431/125
5,423,675 A * 6/1995 Kratsch ..... 431/328
5,975,890 A * 11/1999 Kawasaki et al. ..... 431/328

(Continued)

FOREIGN PATENT DOCUMENTS

GB 2260806 A 4/1993
GB 2284883 A 6/1995

(Continued)

OTHER PUBLICATIONS

Office Action from Japanese Patent App. No. 2010-153618 (Jul. 2, 2013).

(Continued)

*Primary Examiner* — Kenneth Rinehart
*Assistant Examiner* — Jorge Pereiro
(74) *Attorney, Agent, or Firm* — Cermak Nakajima McGowan LLP; Tomoko Nakajima

(57) ABSTRACT

A totally aerated combustion burner having a combustion plate with a multiplicity of flame holes includes a distribution chamber, a mixing chamber, and an air supply chamber. The mixing chamber has a front surface with a plurality of nozzle holes disposed in parallel with, and at a lateral distance from, one another so that a fuel gas to be ejected from the nozzle holes and the primary air from the air supply chamber get mixed in the mixing chamber. A wall plate is disposed upright on a bottom surface of the mixing chamber in a manner to lie opposite to the front surface of the mixing chamber while leaving a ventilation clearance to the front surface. An air inlet is formed in such a portion at the bottom surface of the mixing chamber as to face the ventilation clearance.

3 Claims, 3 Drawing Sheets

(56) References Cited

U.S. PATENT DOCUMENTS

| | | | | |
|---|---|---|---|---|
| 6,095,791 | A * | 8/2000 | Senior | 431/8 |
| 6,676,406 | B2 * | 1/2004 | Suzuki et al. | 431/243 |
| 7,931,468 | B2 * | 4/2011 | Ojiro et al. | 431/354 |
| 2004/0253559 | A1 * | 12/2004 | Schultz et al. | 431/354 |
| 2008/0131828 | A1 * | 6/2008 | Ojiro et al. | 431/350 |
| 2009/0291402 | A1 * | 11/2009 | Cho et al. | 431/278 |

FOREIGN PATENT DOCUMENTS

| | | | | |
|---|---|---|---|---|
| JP | 62-206318 | A | 9/1987 | |
| JP | 05-340519 | A | 12/1993 | |
| JP | 6-46093 | A | 2/1994 | |
| JP | 2000-146127 | A | 5/2000 | |
| JP | 2001-090913 | A | 4/2001 | |
| JP | 2001090913 | A * | 4/2001 | F23D 14/62 |
| JP | 2007-333223 | A | 12/2007 | |
| WO | WO2009/091115 | A2 | 7/2009 | |

OTHER PUBLICATIONS

European Search Report for EP Patent App. No. 11185667.0 (Mar. 27, 2012).

* cited by examiner

TOTALLY AERATED COMBUSTION BURNER

BACKGROUND OF THE INVENTION

1. Field of the Invention

The present invention relates to a totally aerated combustion burner (or a fully primary aerated burner) which is equipped with a combustion plate having formed therein a multiplicity of flame holes and which discharges a premixed gas from the flame holes to perform totally aerated combustion (or fully primary aerated combustion) of the gas.

2. Description of the Related Art

As this kind of totally aerated combustion burner, there is known one described in JP-2001-090913 A. Suppose that such a side of the burner as is equipped with a combustion plate is defined as an upper surface, that a width direction of the burner is defined as a lateral direction, and that a depth direction of the burner is defined as a longitudinal direction, respectively. Then the burner has: a distribution chamber facing the lower surface of the combustion plate; a mixing chamber located on the lower side of the distribution chamber; an air supply chamber located on the lower side of the mixing chamber, thereby supplying the primary air from a combustion fan; and a plurality of nozzle holes parallely formed in the front surface of the mixing chamber at a lateral distance from one another. It is thus so arranged that the fuel gas ejected from these nozzle holes and the primary air from the air supply chamber get mixed in the mixing chamber, thereby generating a premixed gas, and that the premixed gas is introduced into the combustion plate through the distribution chamber.

Moreover, at the front part of the mixing chamber, the burner has disposed therein an inclined plate extending from the front side of the mixing chamber in a manner to be inclined upward toward the rear thereof. The inclined plate is provided with a plurality of openings at a lateral distance from one another so as to introduce therein the primary air from the air supply chamber. It is so arranged that the fuel gas ejected from each of the nozzle holes comes into collision with that portion of the inclined plate which is free from formation of the openings (also referred to as "an opening-free portion"), thereby diffusing the fuel gas. According to this arrangement, the diffused fuel gas gets mixed with the primary air introduced from the openings so that the mixing of the fuel gas with the primary air is accelerated.

However, in the prior art as described above, if the position of the opening-free portion in the inclined plate and the position of the nozzle holes are out of lateral alignment with each other, the fuel gas ejected from the nozzle holes sometimes does not collide with the opening-free portion of the inclined plate but enters the openings, resulting in poor mixing of the fuel gas and the primary air. Accordingly, it becomes necessary to accurately align the opening-free portion with the nozzle holes. As a result, the assembling of the above-mentioned parts becomes troublesome, thereby bringing about an increase in cost.

SUMMARY

It is an object of the invention to provide a totally aerated combustion burner capable of stably mixing the fuel gas and the primary air even if the nozzle holes are out of alignment in some degree.

In order to achieve the above-mentioned object, according to the invention, there is provided a totally aerated combustion burner equipped with a combustion plate in which a multiplicity of flame holes are formed to perform totally aerated combustion by ejecting a premixed gas from the flame holes. The burner comprises, when such a side of the burner as is equipped with the combustion plate is defined as an upper surface, a width direction of the burner is defined as a lateral direction, and a depth direction of the burner is defined as a longitudinal direction: a distribution chamber facing a lower surface of the combustion plate; a mixing chamber on a lower side of the distribution chamber; and an air supply chamber on a lower side of the mixing chamber to thereby supply primary air from a combustion fan. The mixing chamber has a front surface with a plurality of nozzle holes disposed in parallel with, and at a lateral distance from, one another so that a fuel gas to be ejected from the nozzle holes and the primary air from the air supply chamber get mixed in the mixing chamber to thereby generate the premixed gas for introduction thereof to the combustion plate through the distribution chamber. The burner also comprises: a wall plate disposed upright on a bottom surface of the mixing chamber in a manner to lie opposite to the front surface of the mixing chamber while leaving a ventilation clearance to the front surface so that the fuel gas ejected from each of the nozzle holes collides with the wall plate; and an air inlet formed in such a portion at the bottom surface of the mixing chamber as to face the ventilation clearance, the air inlet being for introducing the primary air from the air supply chamber into the mixing chamber.

According to the invention, the primary air flows from the air supply opening through the ventilation clearance between the front surface of the mixing chamber and the wall plate. Then, the fuel gas ejected from each of the nozzle holes collides with the wall plate and is diffused. The diffused fuel gas gets mixed with the primary air that flows through the ventilation clearance, and the mixing of the fuel gas and the primary air is accelerated. It is to be noted here that openings for introducing the primary air need not be formed in the wall plate. Therefore, even if the nozzle holes are deviated sidewise in some degree relative to the wall plate, it is possible to cause the fuel gas to collide with the wall plate to thereby stably mix the fuel gas and the primary air together. Accurate alignment between the nozzle holes and the wall plate consequently becomes unnecessary. As a result, the assembly of the burner becomes easy, and the cost reduction thereof can be achieved.

Now, if the wall plate stands vertically, there is a possibility that the primary air flowing through the ventilation clearance is not sufficiently supplied to the neighborhood of the wall plate and, therefore, that a part of the fuel gas collided with the wall plate flows to the upper end of the wall plate without getting mixed with the primary air. As a solution, according to the invention, the wall plate is preferably inclined forward in an upward direction. According to this arrangement, the primary air introduced from the air inlet into the ventilation clearance collides with the wall plate from the lower side, so that the mixing of the primary air with the fuel gas flowing along the wall plate is accelerated. In addition, unlike the case in which the wall plate is disposed, without inclination, closer to the nozzle holes so that the longitudinal width of the ventilation clearance is made smaller, the air inlet is wide and the ventilation clearance becomes gradually smaller toward the upper side, whereby the pressure loss can be reduced.

In case the air supply chamber has an air supply opening which is formed on the bottom surface of the air supply chamber at a position rearward of the air inlet so that the primary air from the combustion fan flows into the air inlet, there will be generated a flow of the primary air along the ceiling portion of the air supply chamber toward the air inlet. As a result, the primary air will flow into the air inlet while it has a forward-looking directional component. Then, the primary air flows partially toward that portion of the ventilation clearance which lies closer to the front end thereof. Consequently, the primary air will not collide with the wall plate successfully. As a solution, preferably a guide plate is disposed vertically downward at a longitudinal position between the air inlet in a ceiling portion of the air supply chamber and the air supply opening such that the flow of the primary air directed to the air inlet along the ceiling portion of the air supply chamber is curved downward to a portion below the air inlet. According to this arrangement, the primary air can be effectively prevented from flowing into the air inlet while it maintains a forward-looking directional component. As a result, the primary air efficiently collides with the wall plate, so that the mixing of the fuel gas with the primary air can be accelerated.

Moreover, according to the invention, preferably the burner further comprises gutter-shaped baffle plates each being disposed in the ventilation clearance so as to be longitudinally elongated under the respective nozzle holes, and rising plate portions on respective lateral sides of each baffle plate are laterally inclined so that the upper-side distance of the rising plate portions becomes larger.

According to this arrangement, the primary air is obstructed by the baffle plates and does not collide with the fuel gas to be ejected from each of the nozzle holes. It is consequently possible to make the fuel gas surely collide with the wall plate without being influenced by the primary air even at the time of a weak burn at which the ejection of the fuel gas is made small in quantity. The mixing of the fuel gas and the primary air can thus be accelerated. Moreover, because the rising plate portions on respective lateral sides of each baffle plate are inclined so that the upper-side distance of the rising plate portions becomes larger, the primary air does not hit the fuel gas ejected from each of the nozzle holes even if the nozzle holes are somewhat deviated sidewise relative to the baffle plates. Accurate alignment of the nozzle holes and the baffle plates therefore becomes unnecessary.

By the way, it is also conceivable to widen the breadth between the rising plate portions on both lateral sides of each of the baffle plates all the way down to the lower ends thereof. In such an arrangement, however, the pressure loss of the primary air flowing between the adjoining baffle plates becomes large. In contrast to this, if the rising plate portions are laterally inclined as described above, the clearance between the adjoining baffle plates becomes larger at the lower part of the clearance, and the pressure loss of the primary air can thus be reduced.

Moreover, in case the above-mentioned baffle plates and the guide plate are disposed, preferably a plurality of the baffle plates are integrally press-formed into a single piece of plate member with a rear end portion thereof being bent downward to form the guide plate. According to this arrangement, the number of parts of the burner can be reduced, and a still further cost reduction thereof can be achieved.

DETAILED DESCRIPTION OF PREFERRED EMBODIMENTS

Figure 1:
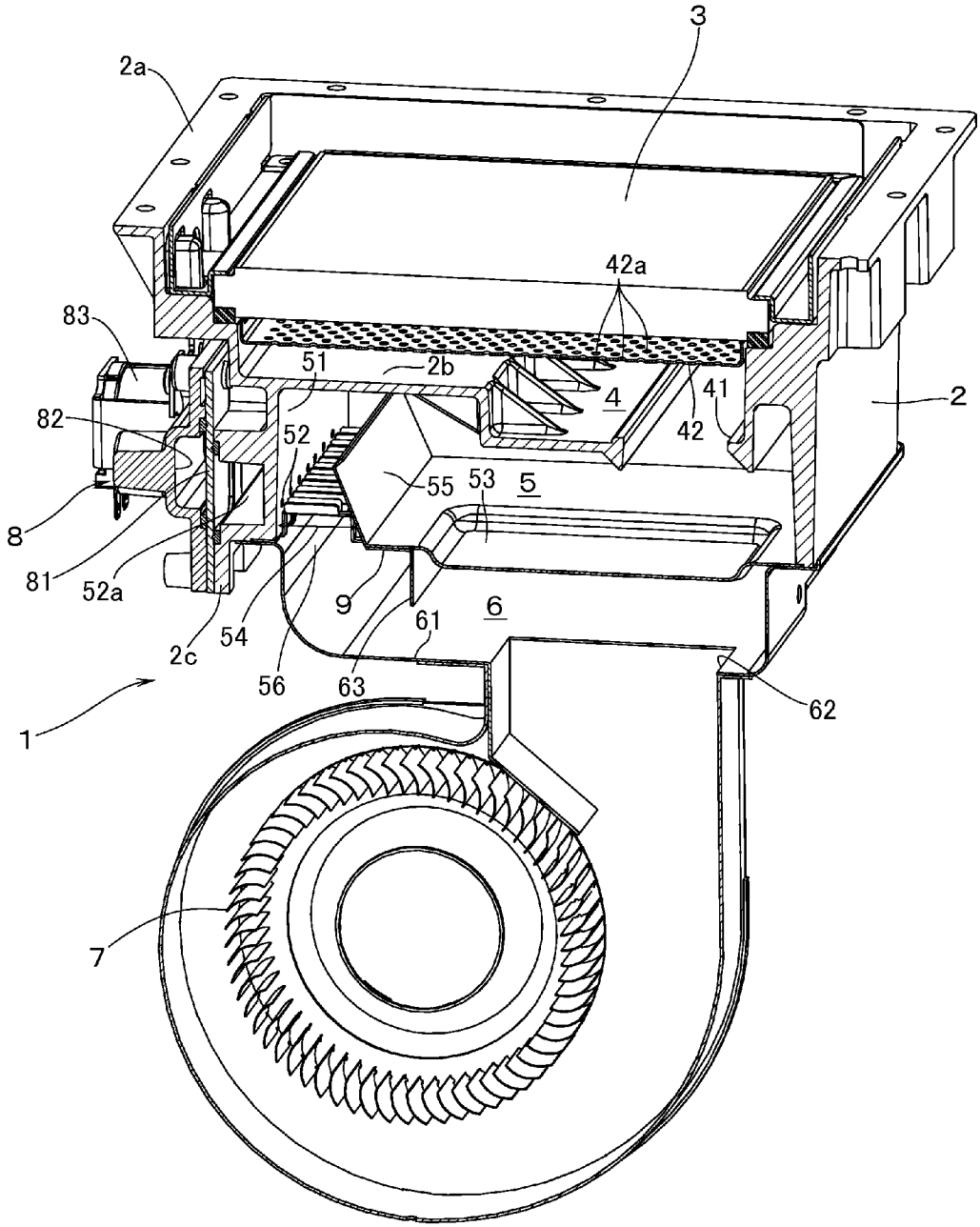
FIG. 1 is a perspective view, partly shown in section, of a burner according to an embodiment of this invention.
Figure 2:
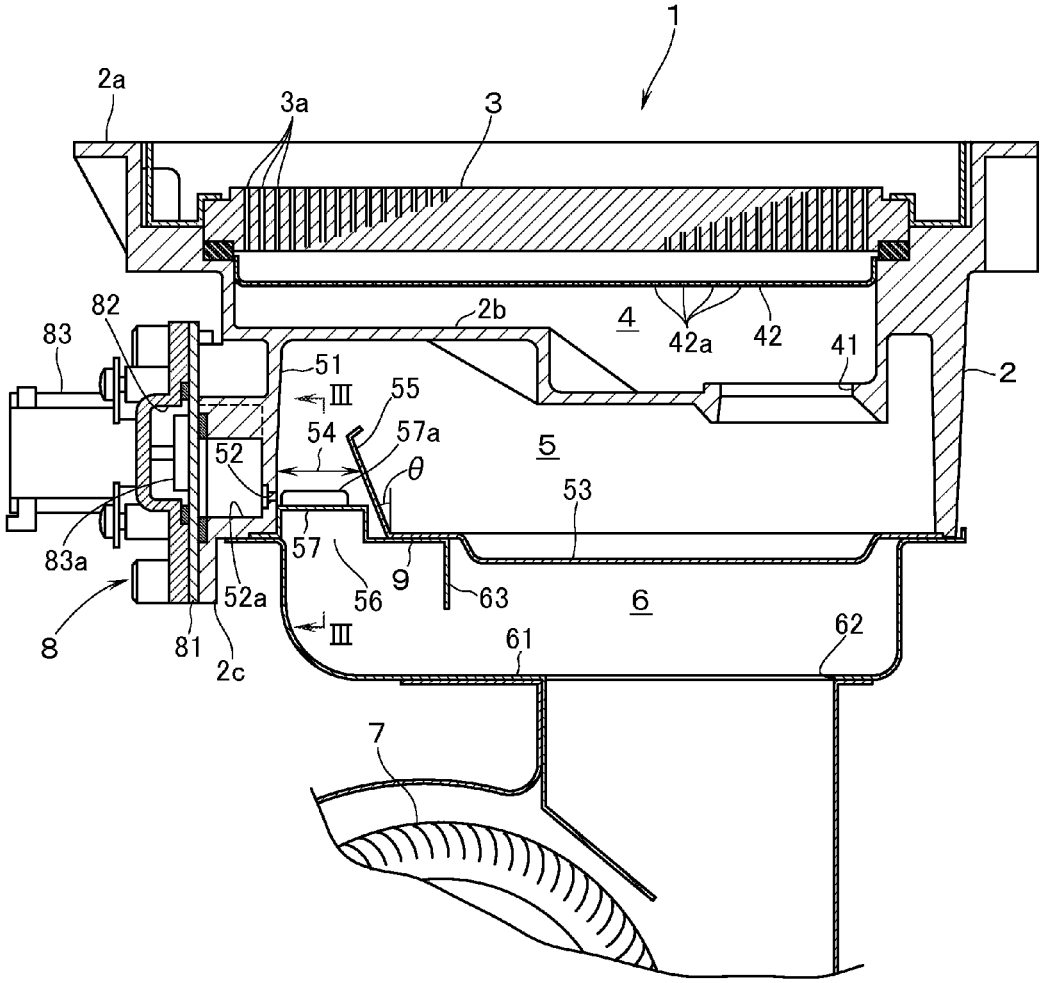
FIG. 2 is a sectional side view of the burner according to the embodiment.

FIGS. 1 and 2 show a totally aerated combustion burner 1 according to one embodiment of the invention. The burner 1 has a burner main body 2 which is formed into a box shape, and a combustion plate 3 which is made of ceramics and which is provided with a multiplicity of flame holes 3*a*. By the way, the flame holes 3*a* are not illustrated in FIG. 1. The description is made in the following on condition that such a side of the burner as is equipped with the combustion plate 3 is defined as an upper surface, that the width direction of the burner 1 is defined as a lateral direction, and that the depth direction of the burner 1 is defined as a longitudinal direction.

On an outer peripheral part of the upper surface of the burner main body 2, there is disposed a flange portion 2*a* to which is connected a lower end of a combustion housing (not illustrated) in which are housed an object to be subjected to heating, such as a heat exchanger, and the like. Further, the burner main body 2 contains therein: a distribution chamber 4 which faces the lower surface of the combustion plate 3; and, on the lower side thereof, a mixing chamber 5 which is partitioned from the distribution chamber 4 by a floor wall 2*b* which is integral with the burner main body 2. Still furthermore, an air supply chamber 6 is disposed on the lower side of the mixing chamber 5. It is thus so arranged that the primary air is supplied to the air supply chamber 6 by a combustion fan 7.

At a rear part of the floor wall 2*b* which is the bottom surface of the distribution chamber 4, there is formed a laterally elongated opening portion 41 which is communicated with the mixing chamber 5. The distribution chamber 4 is partitioned into an upper and a lower, i.e., a total of two, spaces by a partition plate 42. It is thus so arranged that a premixed gas that has flown into the lower space of the distribution chamber 4 through the opening portion 41 is introduced into the combustion plate 3 through a multiplicity of distribution holes 42*a*, formed in the partition plate 42, and the upper space of the distribution chamber 4. The premixed gas introduced into the combustion plate 3 is ejected from the flame holes 3*a* so as to perform totally aerated combustion.

The front surface 51 of the mixing chamber 5 is closed by a vertical wall 2*c* which is integral with the burner main body 2. The front surface 51 is provided with a plurality of nozzle holes 52 which are made up of holes penetrating the vertical wall 2*c* in a manner parallel with, and at a lateral distance from, one another. Moreover, on an outer surface of the vertical wall 2*c*, there is mounted a gas manifold 8 through a partition plate 81 which defines a nozzle passage 52*a* communicating with the plurality of nozzle holes 52. The partition plate 81 is provided with an opening (not illustrated) which communicates a gas passage 82 inside the gas manifold 8 and the nozzle passage 52*a* together. The gas manifold 8 is provided with a solenoid valve 83 having a valve body 83*a* which opens and closes the above-mentioned opening. It is thus so arranged that, when the solenoid valve 83 is opened, the fuel gas is supplied to the nozzle passage 52*a* so that the fuel gas is ejected from each of the nozzle holes 52.

On the bottom surface 53 of the mixing chamber 5, there is disposed a wall plate 55 upright in a manner to lie opposite to the front surface 51 of the mixing chamber 5 while leaving (or maintaining) a ventilation clearance 54 between the front surface 51 and the wall plate 55 so that the fuel gas to be ejected from each of the nozzle holes 52 collides with the wall plate 55. The wall plate 55 is inclined upward in a forward direction at a predetermined angle θ. If this inclination angle θ is set to be too large, the pressure loss at the ventilation clearance 54 increases. Accordingly, the inclination angle θ shall preferably be set to a range of 5 degrees to 45 degrees. In this embodiment, the inclination angle θ is set to about 20 degrees. In that portion of the bottom surface 53 of the mixing chamber 5 which faces the ventilation clearance 54, there is formed a laterally elongated air inlet 56 which introduces the primary air from the air supply chamber 6 into the mixing chamber 5. Further, in this embodiment, there are formed the wall plate 55 and the air inlet 56 by bending a front portion of a plate member which is other than the burner main body 2 that constitutes the bottom surface 53 of the mixing chamber 5.

Figure 3:
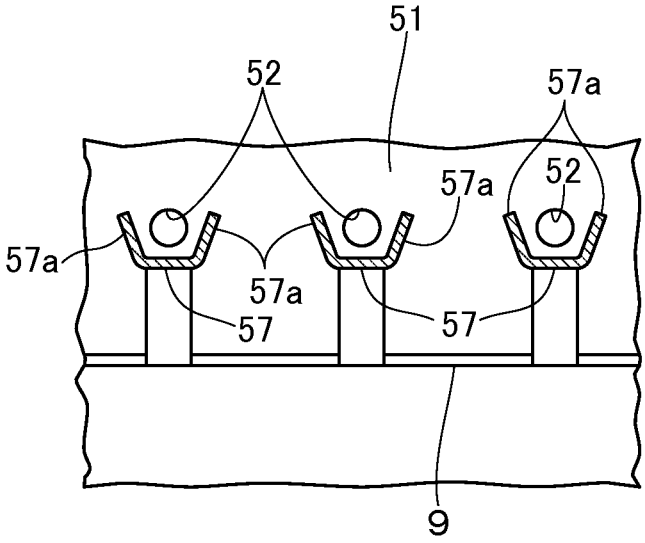
FIG. 3 is an enlarged sectional view of the burner taken along the line III-III in FIG. 2.

Furthermore, the ventilation clearance 54 is provided with a longitudinally elongated baffle plate 57 so as to be positioned under each of the nozzle holes 52. Each of the baffle plates 57 is formed, as shown in FIG. 3, into a gutter (or trough) shape having rising (or erected) plate portions 57*a*, 57*a* on respective lateral sides of each baffle plate 57. The rising plate portions 57*a*, 57*a* on lateral sides are inclined in the lateral direction so that the lateral distance between the rising plate portions 57*a*, 57*a* becomes larger toward the upper side. The rising plate portions 57*a* are not disposed in that rear portion of the baffle plates 57 which is closer to the wall plate 55.

At a position nearer to the rear side than the air inlet 56, the bottom surface 61 of the air supply chamber 6 is provided with an air supply opening 62 into which the primary air from the combustion fan 7 flows. Moreover, at a longitudinal position between the air inlet 56 in the ceiling portion of the air supply chamber 6 and the air supply opening 62, there is disposed a guide plate 63 vertically downward so as to introduce the flow of the primary air which is directed to the air inlet 56 along the ceiling portion of the air supply chamber 6, by curving it (i.e., the flow of the primary air) downward to a position below the air inlet 56. In this embodiment, a single piece of plate member 9 is press-formed to thereby integrally form a plurality of baffle plates 57. The rear end portion of this plate member 9 is bent downward to thereby form the guide plate 63.

According to this embodiment, the primary air flows from the air inlet 56 through the ventilation clearance 54 between the front surface 51 of the mixing chamber 5 and the wall plate 55. The fuel gas ejected from each of the nozzle holes 52 collides with the wall plate 55 and is diffused. The diffused fuel gas gets mixed with the primary air that flows through the ventilation clearance 54 to thereby accelerate the mixing of the fuel gas and the primary air. The fuel gas and the primary air get sufficiently mixed with each other while they flow from the ventilation clearance 54 to that portion of the mixing chamber 5 which lies rearward of the wall plate 55, whereby a homogeneous premixed gas sufficiently mixed together is generated.

Unlike the inclined plate in the above-mentioned conventional example, it is not necessary in this invention to form in the wall plate 55 the opening portion for introducing the primary air. Accordingly, even if the nozzle holes 52 are somewhat deviated sidewise relative to the wall plate 55, it is still possible to cause the fuel gas to collide with the wall plate 55 to thereby stably mix the fuel gas and the primary air together. Consequently, accurate positional alignment of the nozzle holes 52 with the wall plate 55 becomes unnecessary. As a result, the assembly of the burner becomes easy, and the cost reduction thereof can be achieved.

By the way, if the wall plate 55 stands upright, there is a possibility that the primary air flowing through the ventilation clearance 54 is not sufficiently supplied to the neighborhood of the wall plate 55, and that part of the fuel gas which is collided with the wall plate 55 flows to the upper end of the wall plate without getting mixed with the primary air. In contrast to this, according to this embodiment, since the wall plate 55 is forwardly inclined in the upward direction, the primary air to be introduced from the air inlet 56 into the ventilation clearance 54 collides with the wall plate 55 from the lower part thereof to thereby accelerate the mixing of the primary air with the fuel gas flowing along the wall plate 55. Moreover, unlike the case in which the wall plate 55 is made close to the nozzle holes 52 without inclining it so that the longitudinal width of the ventilation clearance 54 is made narrower, the air inlet 56 remains wider and the ventilation clearance 54 gradually gets narrower toward the upper end. Therefore, the pressure loss can be reduced and the rotational number of the combustion fan 7 can be made smaller. As a result, the noise of the fan can be reduced.

By the way, if the primary air that has flown from the air supply opening 62 into the air supply chamber 6 along the ceiling portion of the air supply chamber 6 while maintaining the forward-looking directional component, the primary air will flow partially to the forward-side portion of the ventilation clearance 54. As a result, the primary air will not collide with the wall plate 55. According to this embodiment, however, due to the guide plate 63 vertically and downwardly disposed on the ceiling portion of the air supply chamber 6, the flow of the primary air that is directed toward the air inlet 56 along the ceiling portion of the air supply chamber 6 will be guided downward. It is thus possible to effectively prevent the primary air from flowing into the air inlet 56 while maintaining the forward-looking directional component. As a result, the primary air efficiently collides with the wall plate 55 and the mixing of the fuel gas and the primary air can be accelerated. Further, the fact that the rear portion of the baffle plates 57 is not provided with the rising plate portions 57*a* also contributes to the improvement in the efficiency of collision of the primary air with the wall plate 55.

Moreover, because the primary air is disturbed by the baffle plates 57, the primary air will not collide with the fuel gas ejected from each of the nozzle holes 52. Therefore, even at the time of weak burning at which the amount of ejection of the fuel gas is made small, the fuel gas can be caused to surely collide with the wall plate 55 without being influenced by the primary air, whereby the mixing of the fuel gas and the primary air can be accelerated. Further, since the distance between the upper ends of the rising plate portions 57*a*, 57*a* on both lateral sides of the baffle plates 57 is made larger, the primary air will not collide with the fuel gas ejected from the nozzle holes 52 even if the nozzle holes 52 may be slightly deviated sidewise relative to the baffle plates 57. Accordingly, accurate positional alignment between the nozzle holes 52 and the baffle plates 57 becomes unnecessary.

By the way, it is also conceivable to widen the lateral width between the rising plate portions 57*a* on both sides of each of the baffle plates 57 down to the lower ends of the rising plate portions 57*a*. In such an arrangement, however, the pressure loss of the primary air to flow through the adjoining baffle plates 57, 57 will become large. On the other hand, if the rising plate portion 57*a* is laterally inclined as in this embodiment, the clearance between the adjoining baffle plates 57, 57 will become wider at their lower portions, whereby the pressure loss of the primary air can be reduced.

Moreover, because the plurality of baffle plates 57 and the guide plate 63 are integrally press-formed into a single piece of sheet plate member 9 in this embodiment, the number of parts can be reduced, and further cost reduction can be achieved.

Although the embodiment of the invention has been described above with reference to the accompanying drawings, the invention is not limited to the embodiment. For example, although the front surface 51 of the mixing chamber 5 is closed by the vertical wall 2*c* that is integral with the burner main body 2 in the above-mentioned embodiment, a gas manifold may be installed on the front surface 51 of the mixing chamber 5 so as to close the front surface 51. In this case, a plurality of nozzle holes are formed in parallel with one another on the gas manifold.

Moreover, although such a side of the burner as is equipped with the combustion plate is defined as the upper surface, the upper and the lower directions do not define the direction at the time of using the burner. This invention includes not only a burner to be used in an overhead posture in which the combustion plate 3 is directed upward, but also a burner to be used in a downward posture in which the combustion plate 3 is directed downward, as well as in a lateral posture in which the combustion plate 3 is directed laterally.

What is claimed is:

1. A totally aerated combustion burner equipped with a combustion plate in which a multiplicity of flame holes are formed to perform totally aerated combustion by ejecting a premixed gas from the flame holes, the burner comprising, when such a side of the burner as is equipped with the combustion plate is defined as an upper surface, a width direction of the burner is defined as a lateral direction, and a depth direction of the burner is defined as a longitudinal direction:

a distribution chamber facing a lower surface of the combustion plate;

a mixing chamber on a lower side of the distribution chamber;

an air supply chamber on a lower side of the mixing chamber to thereby supply primary air from a combustion fan, wherein the mixing chamber has a front surface with a plurality of nozzle holes disposed in parallel with, and at a lateral distance from, one another so that a fuel gas to be ejected from the nozzle holes and the primary air from the air supply chamber get mixed in the mixing chamber to thereby generate the premixed gas for introduction thereof to the combustion plate through the distribution chamber;

a wall plate disposed upright on a bottom surface of the mixing chamber in a manner to lie opposite to the front surface of the mixing chamber while leaving a ventilation clearance to the front surface so that the fuel gas ejected from each of the nozzle holes collides with the wall plate;

an air inlet formed in such a portion at the bottom surface of the mixing chamber as to face the ventilation clearance, the air inlet being for introducing the primary air from the air supply chamber into the mixing chamber; and gutter-shaped baffle plates each being disposed in the ventilation clearance so as to be longitudinally elongated under the respective nozzle holes, wherein rising plate portions on respective lateral sides of each baffle plate are laterally inclined so that the upper-side distance of the rising plate portions becomes larger.

2. A totally aerated combustion burner equipped with a combustion plate in which a multiplicity of flame holes are formed to perform totally aerated combustion by ejecting a premixed gas from the flame holes, the burner comprising, when such a side of the burner as is equipped with the combustion plate is defined as an upper surface, a width direction of the burner is defined as a lateral direction, and a depth direction of the burner is defined as a longitudinal direction:

a distribution chamber facing a lower surface of the combustion plate;

a mixing chamber on a lower side of the distribution chamber;

an air supply chamber on a lower side of the mixing chamber to thereby supply primary air from a combustion fan, wherein the mixing chamber has a front surface with a plurality of nozzle holes disposed in parallel with, and at a lateral distance from, one another so that a fuel gas to be ejected from the nozzle holes and the primary air from the air supply chamber get mixed in the mixing chamber to thereby generate the premixed gas for introduction thereof to the combustion plate through the distribution chamber;

a wall plate disposed upright on a bottom surface of the mixing chamber in a manner to lie opposite to the front surface of the mixing chamber while leaving a ventilation clearance to the front surface so that the fuel gas ejected from each of the nozzle holes collides with the wall plate; and an air inlet formed in such a portion at the bottom surface of the mixing chamber as to face the ventilation clearance, the air inlet being for introducing the primary air from the air supply chamber into the mixing chamber, wherein the wall plate is inclined forward in an upward direction, and the air supply chamber has an air supply opening which is formed on the bottom surface of the air supply chamber at a position rearward of the air inlet so that the primary air from the combustion fan flows into the air inlet, wherein the burner further comprises a guide plate disposed vertically downward at a longitudinal position between the air inlet in a ceiling portion of the air supply chamber and the air supply opening such that the flow of the primary air directed to the air inlet along the ceiling portion of the air supply chamber is curved downward to a portion below the air inlet.

3. The totally aerated combustion burner according to claim 2, further comprising:

gutter-shaped baffle plates each being disposed in the ventilation clearance so as to be longitudinally elongated under the respective nozzle holes, wherein rising plate portions on respective lateral sides of each baffle plates are laterally inclined so that the upper-side distance of the rising plate portions becomes larger, and wherein a plurality of the baffle plates are integrally press-formed into a single piece of plate member with a rear end portion thereof being bent downward to form the guide plate.

* * * * *